US010767433B2

(12) United States Patent
Hussain et al.

(10) Patent No.: US 10,767,433 B2
(45) Date of Patent: Sep. 8, 2020

(54) INTEGRATED CONTROLS FOR SUBSEA LANDING STRING, BLOW OUT PREVENTER, LOWER MARINE RISER PACKAGE

(71) Applicant: OneSubsea IP UK Limited, London (GB)

(72) Inventors: Bilal Rafaqat Hussain, Houston, TX (US); Khurram Rehmatullah, Houston, TX (US); Christopher Nault, Houston, TX (US); Vikas Rakhunde, Houston, TX (US); Darcy Ryan, Missouri City, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/904,736

(22) Filed: Feb. 26, 2018

(65) Prior Publication Data

US 2019/0264524 A1 Aug. 29, 2019

(51) Int. Cl.

| | |
|---|---|
| ***E21B 33/035*** | (2006.01) |
| ***E21B 33/038*** | (2006.01) |
| ***E21B 33/064*** | (2006.01) |
| ***E21B 33/06*** | (2006.01) |

(52) U.S. Cl.

CPC ..... *E21B 33/0355* (2013.01); *E21B 33/038* (2013.01); *E21B 33/064* (2013.01); *E21B 33/063* (2013.01)

(58) Field of Classification Search

CPC .. E21B 33/0355; E21B 33/038; E21B 33/064; E21B 33/063

See application file for complete search history.

(56) References Cited

U.S. PATENT DOCUMENTS

| | | | | |
|---|---|---|---|---|
| 3,488,031 | A * | 1/1970 | Taylor, Jr. | E21B 33/038 251/148 |
| 3,640,299 | A * | 2/1972 | Nelson | E21B 33/0355 137/1 |
| 4,328,826 | A * | 5/1982 | Baugh | E21B 33/0355 137/236.1 |
| 5,971,072 | A | 10/1999 | Huber et al. | |
| 8,061,430 | B2 | 11/2011 | Du et al. | |
| 9,458,689 | B2 * | 10/2016 | Mancuso | E21B 33/0355 |

(Continued)

FOREIGN PATENT DOCUMENTS

| | | | | |
|---|---|---|---|---|
| EP | 2458142 | A2 | 5/2012 | |
| GB | 2338971 | A * | 1/2000 | E21B 33/035 |

(Continued)

OTHER PUBLICATIONS

Extended European Search Report issued in European Patent Appl. No. 19158813.6 dated Jul. 1, 2019; 7 pages.

*Primary Examiner* — James G Sayre
(74) *Attorney, Agent, or Firm* — Helene Raybaud

(57) ABSTRACT

A controls module for use with a subsea landing string, a blowout preventer (BOP) stack and a lower marine riser package (LMRP) is disclosed. The controls module can be integrated into the BOP stack or the LMRP or between the BOP stack and the LMRP. The controls module includes an input line that is coupled to control the subsea landing string through the BOP or the LMRP. The input line can be a hydraulic line, an electrical line, or a combination.

24 Claims, 5 Drawing Sheets

(56) References Cited

U.S. PATENT DOCUMENTS

| | | | | |
|---|---|---|---|---|
| 2014/0064029 | A1* | 3/2014 | Jaffrey | E21B 33/0355 367/81 |
| 2015/0240585 | A1* | 8/2015 | Mancuso | E21B 33/0355 166/338 |
| 2016/0131692 | A1* | 5/2016 | Jaffrey | G01R 31/1272 324/544 |

FOREIGN PATENT DOCUMENTS

| | | | | |
|---|---|---|---|---|
| WO | 2014210435 | A1 | 12/2014 | |
| WO | WO-2017049071 | A4 * | 4/2017 | E21B 19/002 |

* cited by examiner

INTEGRATED CONTROLS FOR SUBSEA LANDING STRING, BLOW OUT PREVENTER, LOWER MARINE RISER PACKAGE

BACKGROUND

A subsea well intervention system typically employs equipment such as a blowout preventer (BOP) stack, a subsea landing string (SSLS), and a lower marine riser package (LMRP). These components cooperate together to maintain pressure control and enable access to the subsea well. Operating these components together presents certain challenges and complexities. Conventionally controls to these components are independent and have redundant functionality, and are therefore inefficient.

SUMMARY

Embodiments of the present disclosure are directed to a system including a subsea landing string, blow out preventer, and a lower marine riser package coupled to a wellhead system on a seabed. The system includes a controls module located between the BOP stack below and the LMRP above to provide coupling of the BOP and LMRP controls through the drill through column to the SLSS controls. The controls module has an input line, a second input line component, and a coupling mechanism. The coupling mechanism is configured to couple the first input line component to the second input line component. The one or more actuatable components in the BOP and the LMRP are configured to receive an input from the input line in the controls module. The actuatable components of the SLSS is configured to receive an input from the second line component via the coupling mechanism.

Further embodiments of the present disclosure are directed to a controls module including a plurality of ports configured to couple with corresponding ports on a subsea landing string on a wellhead. The ports are coupled to input lines operably coupled to a remote control device such as surface controls or a rig. The input lines are configured to provide control inputs for at least one of a blowout preventer (BOP) stack and a lower marine riser package (LMRP).

Still further embodiments of the present disclosure are directed to a method of installing and operating a subsea landing string. The method includes installing a lower marine riser package (LMRP) onto a blowout preventer (BOP) stack, the controls module having an input line and a coupling mechanism. The subsea landing string has one or more input ports. The method also includes actuating the coupling mechanism to couple the input line to the ports. The ports are operably coupled to components within the subsea landing string. The method further includes operating the components via the input line and the ports.

DETAILED DESCRIPTION

Figure 1:
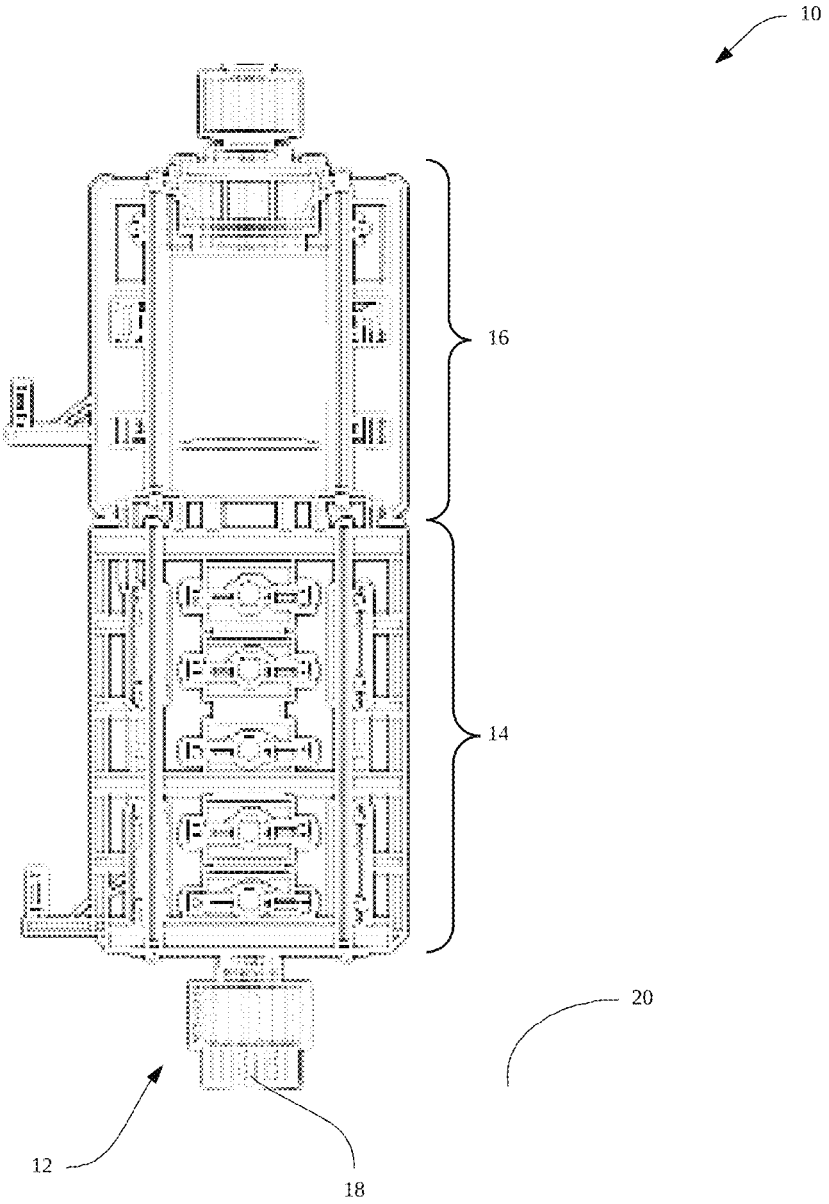
Figure 1 (prior art)
FIG. 1 illustrates an assembly including a subsea landing string (SSLS) and, a BOP stack, and an LMRP according to the prior art.

Below is a detailed description according to various embodiments of the present disclosure. Throughout this disclosure, relative terms such as above or below generally refer to an orientation relative to a subsea surface but are not to be construed in a limiting manner. FIG. 1 illustrates an assembly 10 including a subsea landing string 12, a BOP stack 14 and a LMRP 16 coupled to the BOP stack 14 and the subsea landing string 12 according to the prior art. The assembly 10 is coupled to the wellhead 18 which can be on the ocean floor 20. The BOP stack 14 is generally installed complete with the LMRP 16. The BOP 14 and the SSLS 12 each can require controls via electronic, hydraulic, or electrohydraulic lines to operate valves, rams, and other equipment. The controls for the BOP 14 and the SSLS 12 are redundant and introduce complexity to the system. The controls for the BOP 14 are independent of the controls for the SLSS 12 and therefore when the full intervention system is installed there are two sets of control lines from the remote control device.

Figure 2:
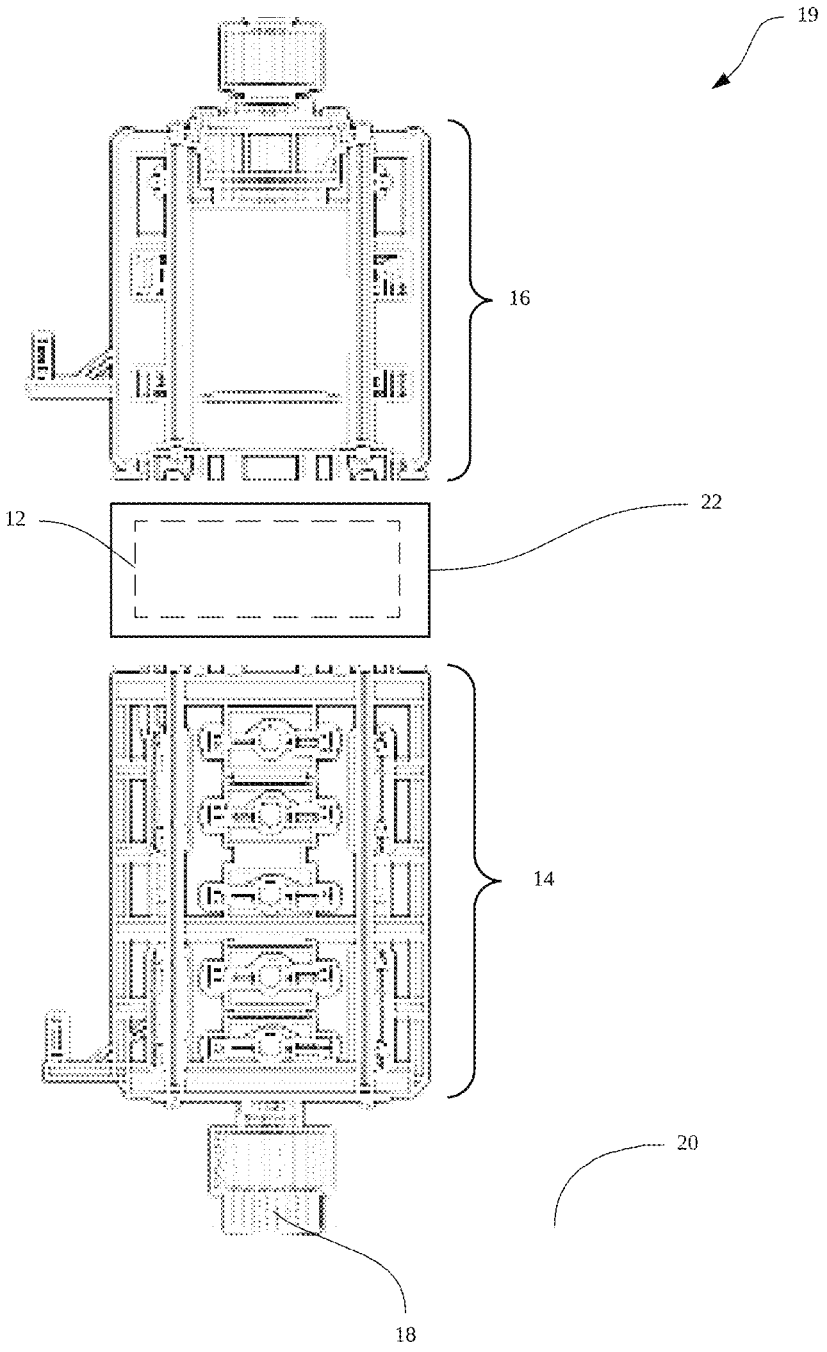
FIG. 2 illustrates a controls module for use with a BOP, LMRP, and an SLSS according to embodiments of the present disclosure.

FIG. 2 illustrates an assembly 19 including a controls module 22 for use with SSLS 12, a BOP 14, and an LMRP 16 according to embodiments of the present disclosure. The controls module 22 can be installed between the BOP 14 and the LMRP 16. In some embodiments the controls module 22 is a separate component which can be installed onto the BOP 14 or onto the LMRP 16. It can be deployed with the BOP 14, or independently before the LMRP 16 is installed. In other embodiments the controls module 22 is integrated with the BOP 14 or with the LMRP 16. The LMRP 16 includes control pods that provide hydraulic, electrical, or combination hydro-electrical controls to the BOP 14. Once the controls module 22 is fully installed it will operate with the BOP 14, LMRP 16, and SLSS 12 in the ways described herein.

Figure 3:
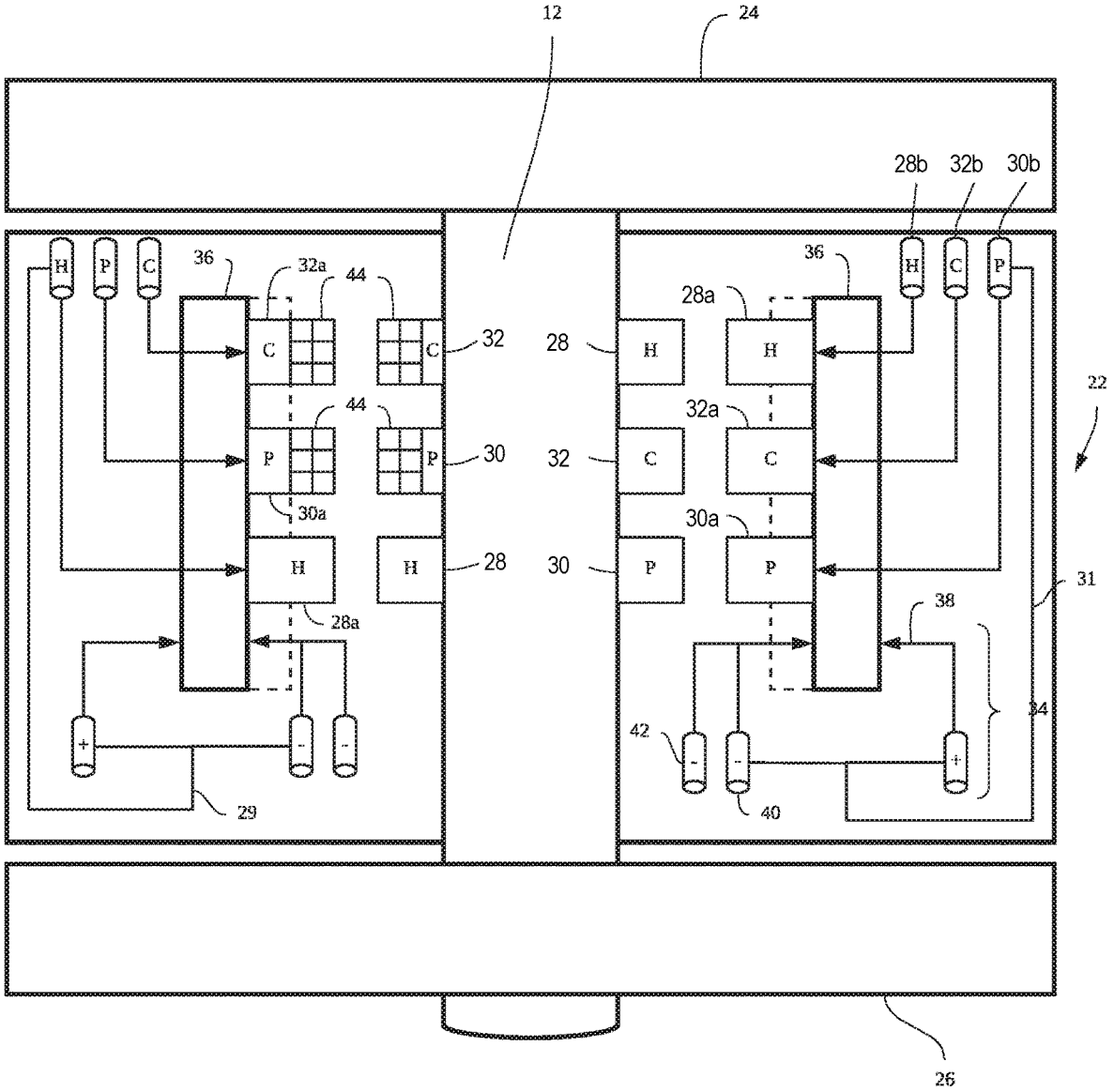
FIG. 3 is a schematic illustration of a controls module according to embodiments of the present disclosure.

FIG. 3 is a schematic illustration of a controls module 22 according to embodiments of the present disclosure. The controls module 22 is configured to operate with an annular BOP 24 above and a shear ram 26 below. The controls module 22 is coupled to a subsea landing string (SSLS) 12 and is shown with two halves, one on either side of the SSLS 12. In some embodiments the two halves of the controls module 22 are identical. In other embodiments there can be differences between the halves of the controls module 22 as needed or convenient for a given installation. The SSLS 12 includes one or more control ports such as hydraulic 28, power 30, or communication 32. These are collectively referred to herein as ports without loss of generality and in a non-limiting way. The ports are coupled to corresponding lines 28*b*, 30*b*, and 32*b* which are coupled to a remote control system such as surface controls or a rig. In some embodiments there can be any combination of one, two, or all three types of ports. Furthermore, the orientation and configuration of the ports can vary in a given installation. The ports can be used for any control input needed in the form of hydraulic, electronic, or combination electro-hydraulic (known as MUX control) systems. Unlike conventional systems which typically require separate hydraulic, power and/or communication lines for the SSLS 12 run internally within the drill through column and the BOP stack 14/LMRP 16 run external to the drill through column, this present disclosure enables the use of fewer hydraulic, power and/or communication lines running to the seabed by piggy-backing SSLS 12 control conduits onto existing BOP 14/LMRP 16 control conduits.

The controls module 22 includes complementary ports 28*a*, 30*a*, and 32*a* which are configured to couple to their counterparts 28, 30, and 32, respectively. The controls module 22 also includes a coupling mechanism 34 configured to actuate to couple the ports together. In some embodiments the coupling mechanism 34 includes a piston 36 and an actuation component such as a hydraulic control line having an engage line 38 and a disengage line 40. The actuating mechanism 34 can be a screw or a magnetically-actuated mechanism or any other suitable mechanical equivalent. The engage line 38 when actuated imparts pressure to the piston 36 to move the ports 28*a*, 30*a*, and 32*a* toward their counterpart ports 28, 30, and 32 to couple the lines. The coupling mechanism 34 can also include a second disengage line 42 that can be configured as an emergency disengage line 42 that can have a comparatively higher pressure rating and can be operated in concert with emergency procedures and in response to detecting a failure condition. The disengage line 42 can be a "fail open" system under which in the absence of a signal (electronic, mechanical, or hydraulic) the disengage line 42 actuates to uncouple the ports to release the controls module 22. In other embodiments the disengage line 42 can be a "fail closed" system.

In some embodiments the hydraulic line 28*b* can be coupled to the engage line 38, the disengage line 40, or both via a line 29. With this configuration a single hydraulic line can control coupling and uncoupling the ports, as well as provide the hydraulic input for the ports 28 and 28*a*. The controls module 22 can include a mini-indexer or another suitable mechanism to distribute hydraulic inputs whereby a single hydraulic input can actuate multiple outputs. In further embodiments the power line 30*b* can be coupled via an electric line 31 to the coupling mechanism 34 which can be electrically actuated to couple or uncouple the ports. In other embodiment the communication line 32*b* can also be used to perform the same task.

The ports couple together using a variety of different coupling mechanisms, some mechanical, some electrical, some hydraulic. Even among these categories there can be different couplers. For example, a hydraulic line can be coupled via a hydraulic line wet mate (HLWM) provided by SCHLUMBERGER and shown in U.S. Pat. No. 8,061,430. An electrical connection such as for power, communications, or both power and communications can be made using an inductive coupler 44 similar to the inductive coupler provided by SCHLUMBERGER and shown in U.S. Pat. No. 5,971,072. Other mechanical, hydraulic and electric port couplings are compatible with the systems and methods of the present disclosure.

Figure 4:
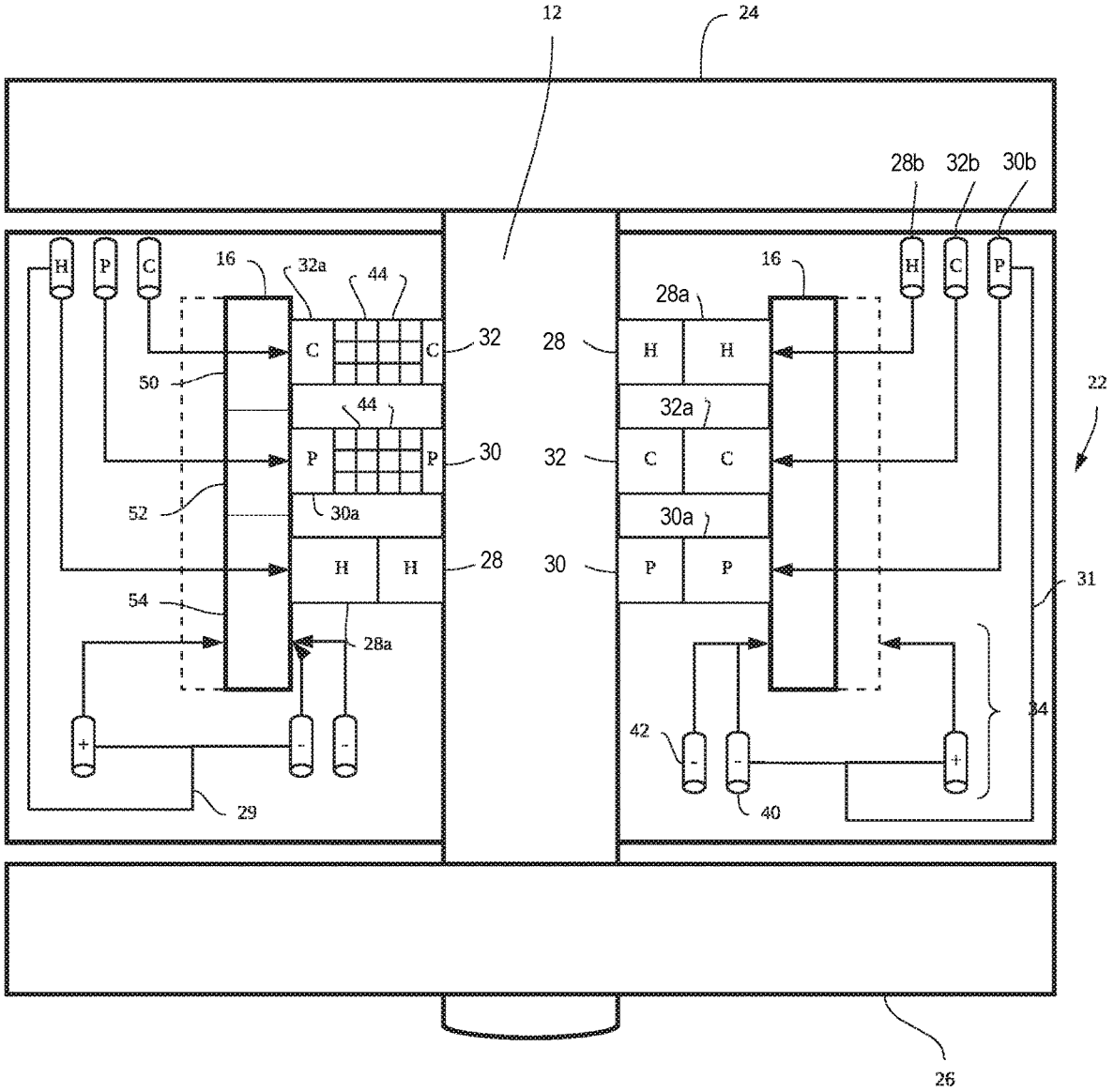
FIG. 4 illustrates the controls module in a deployed configuration according to embodiments of the present disclosure.

FIG. 4 illustrates the controls module 22 in a deployed configuration according to embodiments of the present disclosure. In operation, the BOP 14 and SSLS 12 (shown to greater advantage in FIG. 2) are installed at the wellhead on the subsea surface with the ports in an accessible but protected position. The controls module 22 can be lowered into position with the ports 28*a*, 30*a*, and 32*a* being maneuvered relative to their counterpart ports 28, 30, and 32 on the SSLS 12. Once the controls module 22 is properly positioned, the coupling mechanism 34 can be actuated to couple the ports 28, 30, and 32 to ports 28*a*, 30*a*, and 32*a* to complete the connection between the SSLS 12 and the rig or other controller above.

In some embodiments the SSLS 12 can include any suitable number of ports. FIGS. 3 and 4 show three ports: one hydraulic 28, one for power 30, and one for communication 32. It is to be appreciated that there can be any number of each of these types of ports. In some embodiments there are only one sort. In some embodiments these various ports can be coupled to their counterpart port independently of the other ports and the coupling mechanism 34 will be configured to support this coupling. For example, the coupling mechanism 34 can comprise a plurality of pistons 50, 52, and 54, one for each port. Each piston can be actuated independently to couple (or uncouple) one or more of the ports while leaving other ports uncoupled (or coupled).

Figure 5:
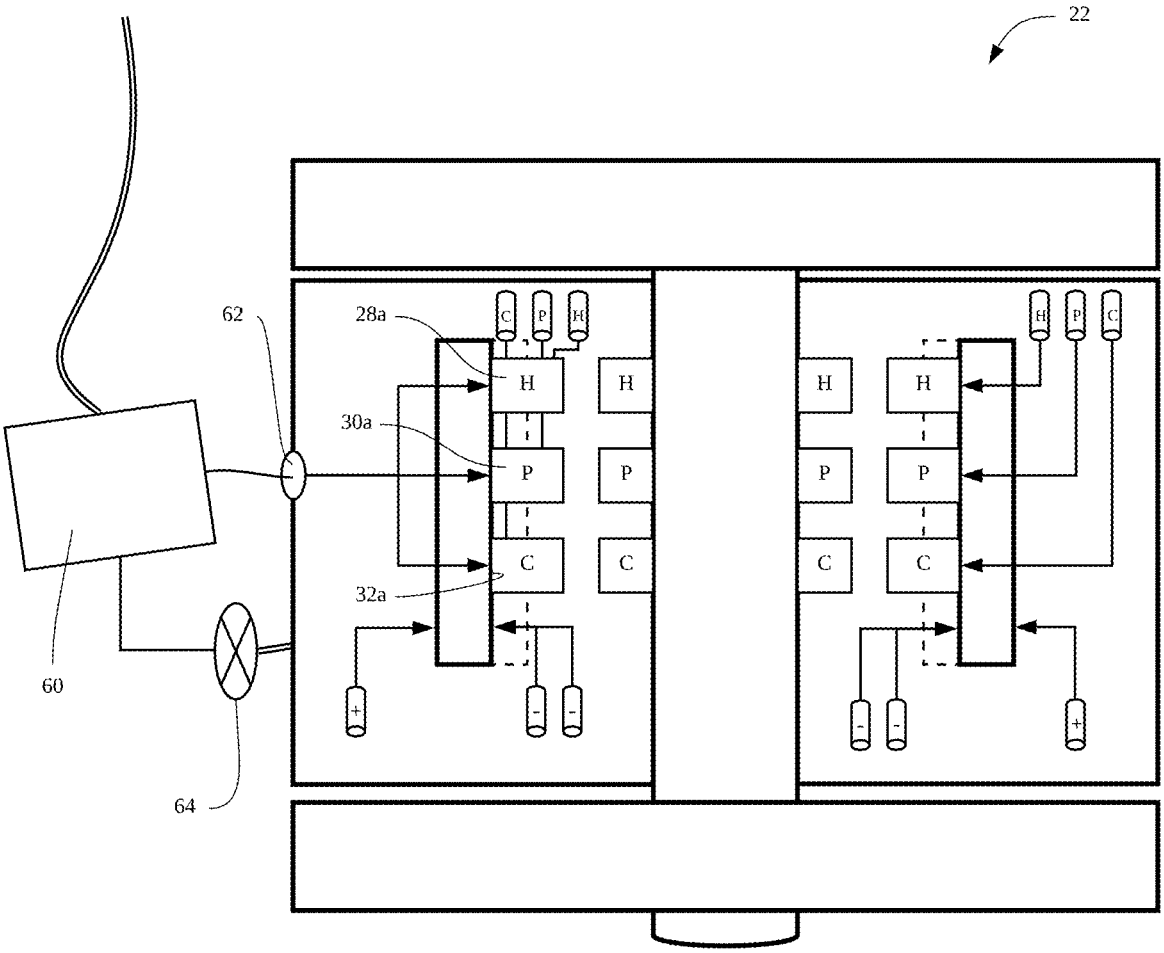
FIG. 5 is an illustration of an embodiment of the controls module including access via a Remotely Operated Vehicle (ROV) according to embodiments of the present disclosure.

FIG. 5 is an illustration of an embodiment of the controls module 22 including access via a Remotely Operated Vehicle (ROV) 60 according to embodiments of the present disclosure. An ROV 60 can be deployed to initiate or terminate a coupling between ports in the controls module 22. The controls module 22 can include access means for the ROV 60. In some embodiments the access means is an external port 62 on the controls module 22 through which the ROV 60 can reach the ports 28*a*, 30*a*, and 32*a*. In some embodiments the ROV 60 is capable or initiating the coupling mechanism 34, or can provide power to initiate a coupling between ports. In some embodiments the controls module 22 can include an externally-actuatable device 64 such as a rotatable wheel. The device 64 can be a switch, a lever, or any other suitable manipulatable device that an ROV can access using an arm 66. In the case that the device 64 is rotatable, the device 64 can be connected to a threaded internal component that causes the ports to couple under power of the rotation. The foregoing disclosure hereby enables a person of ordinary skill in the art to make and use the disclosed systems without undue experimentation. Certain examples are given to for purposes of explanation and are not given in a limiting manner.

The invention claimed is:

1. A subsea landing string, comprising:

a subsea landing string configured to couple to a wellhead on a seabed, the subsea landing string having a first input line component;

a blowout preventer (BOP) stack coupled to the subsea landing string having one or more actuatable components;

a controls module coupled to the subsea landing string above the BOP stack, the controls module comprising an input line, a second input line component, and a coupling mechanism, the coupling mechanism comprising a piston wherein the piston is configured move from a first position to a second position in response to hydraulic and/or electric actuation wherein the coupling mechanism is configured to couple the first input line component to the second input line component in response to movement of the piston from the first position to the second position; and a lower marine riser package (LMRP) coupled to the subsea landing string above the controls module, the LMRP having one or more actuatable components;

wherein the one or more actuatable components in the BOP stack and the LMRP are configured to receive an input from the input line in the controls module.

2. The subsea landing string of claim 1, wherein the controls module is configured to operate with the subsea landing string, the BOP stack, and the LMRP using at least one shared line coupled to the input line.

3. The subsea landing string of claim 1, wherein the input line comprises at least one of a hydraulic line or an electric line.

4. The subsea landing string of claim 1, wherein the input line comprises a plurality of input lines.

5. The subsea landing string of claim 4, wherein the plurality of input lines comprises at least one hydraulic line and an electric line.

6. The subsea landing string of claim 4, wherein the coupling mechanism is configured to couple one or more of the input lines separate from at least one other input line.

7. The subsea landing string of claim 1, wherein the input line comprises a power line and a communication line.

8. The subsea landing string of claim 1, wherein the controls module is configured to be installed as a separate module between the BOP and the LMRP independently from the BOP and the LMRP.

9. The subsea landing string of claim 1, wherein the controls module is integrated into the BOP.

10. The subsea landing string of claim 1, wherein the controls module is integrated into the LMRP.

11. The subsea landing string of claim 1, wherein the controls module includes an external access point configured to be accessed via a remotely operated vehicle (ROV).

12. The subsea landing string of claim 1, wherein the first input line component and the second input line component comprise an inductive coupler.

13. A controls module, comprising:

a plurality of ports configured to couple with corresponding ports on a subsea landing string on a wellhead, wherein the ports are coupled to input lines operably coupled to a remote control device; and a coupling mechanism configured to couple the plurality of ports on the controls module with the corresponding ports on the subsea landing string, wherein the input lines are configured to provide control inputs for both a blowout preventer (BOP) stack and a lower marine riser package (LMRP), the coupling mechanism comprises:

a piston configured to move from a first position to a second position in response to hydraulic and/or electric actuation to move the plurality of ports on the controls module relative to the corresponding ports on the subsea landing string to couple the plurality of ports with the corresponding ports.

14. The controls module of claim 13, wherein the controls module is configured to operate with the subsea landing string, the BOP stack, and the LMRP using a plurality of shared lines coupled to the input lines.

15. The controls module of claim 13, wherein the controls module is integrated with the LMRP.

16. The controls module of claim 13, wherein the controls module is integrated with the BOP.

17. The controls module of claim 13, wherein the input lines are configured to actuate the coupling mechanism.

18. The controls module of claim 13, wherein at least one of the ports is a hydraulic port and at least one other of the ports is an electric line.

19. The controls module of claim 13, wherein the coupling mechanism comprises an emergency disengage component configured to disengage the plurality of ports in response to a predetermined emergency signal.

20. A method, comprising:

coupling together a controls module, a subsea landing string, a lower marine riser package (LMRP), and a blowout preventer (BOP) stack, wherein the controls module comprises an input line and a coupling mechanism;

actuating the coupling mechanism hydraulically and/or electrically to move one or more input ports relative to corresponding ports on the subsea landing string to to couple the input line to the corresponding ports, wherein the one or more input ports are operably coupled to components within the subsea landing string, the LMRP, and the BOP stack; and operating the components via the controls module, the input line, and the one or more input ports.

21. The method of claim 20, wherein the input line comprises at least one of a hydraulic line, an electrical power line, and a communications line.

22. The method of claim 20, further comprising actuating the coupling mechanism to uncouple the input line from the corresponding ports.

23. The method of claim 20, further comprising integrating the controls module into the LMRP.

24. The method of claim 20, further comprising operating the components within the BOP stack, the subsea landing string, and the LMRP via the input line coupled to a shared control line extending to a surface rig.

* * * * *